United States Patent [19]

Bizzéll et al.

[11] 4,105,209

[45] Aug. 8, 1978

[54] ARROW MOUNTED SELF-RETRACTING SIGHT

[76] Inventors: David Bizzéll, 7 Benjamin Hill Rd., Newfield, N.Y. 14867; Eino A. Makarainen, 400 Comfort Rd., Ithaca, N.Y. 14850

[21] Appl. No.: 807,561

[22] Filed: Jun. 17, 1977

[51] Int. Cl.[2] ..... F41B 5/02

[52] U.S. Cl. ..... 273/106.5 R; 33/263

[58] Field of Search ..... 273/106.5 R; 124/86, 124/87; 33/263, 265

[56] References Cited

U.S. PATENT DOCUMENTS

| | | | |
|---|---|---|---|
| 3,273,892 | 9/1966 | Nolting | 33/263 X |
| 3,586,332 | 6/1971 | Alban | 273/106.5 R |

*Primary Examiner*—Paul E. Shapiro

*Attorney, Agent, or Firm*—George E. Clark

[57] ABSTRACT

A self-retracting sight is mounted on the shaft of an arrow to facilitate sighting and aiming of the arrow and thus improve accuracy either in target shooting or in bow hunting. The arrow mounted sight is attached at a point forward of the feathers and has a notch or a peep-site hole cut in a top portion to facilitate sighting. The sight is curved to match the curvature of the shaft of the arrow and is lightweight so that it falls back against the shaft when the bowstring is released by the archer.

5 Claims, 4 Drawing Figures

ARROW MOUNTED SELF-RETRACTING SIGHT

BACKGROUND OF THE INVENTION

In the prior art, it is common to employ bow sights including a bead like peepsite on the bowstring mounted between the strands of the bowstring to provide a sight for the archer.

These types of sights have a disadvantage in that some archers using a particular "anchor point" find it impossible to align this type of sight properly since the string is not in their line of vision.

SUMMARY OF THE INVENTION

Therefore, it is an object of the present invention to sight a bow and arrow through the use of a sight which is mounted on the shaft of the arrow.

It is another object of the present invention to sight and aim a bow and arrow through a sight which is mounted on the shaft of the arrow when the arrow is released from the bow string.

It is yet another object of the present invention to sight a bow and arrow with a sight which is mounted on the shaft of the arrow which sight has a notch or a peepsite hole on the top portion to facilitate precision aiming of the bow and arrow by the archer.

Accordingly, an arrow such as a target arrow or a hunting arrow has mounted thereon at a position forward of the feathers a lightweight sighting device which is pivotally attached to the shaft of the arrow and which is of lightweight construction so that upon release of the bowstring the sighting device will fold back against the shaft of the arrow. The sight includes a notch or peepsite hole at the top to enhance the precision of the aiming of the bow and arrow by the archer. The sight has a curved construction so that it will match the curvature of the shaft of the arrow to which it is mounted and is so mounted that when erect it is not in line with the bowstring. In operation, the sight in conjunction with a pre-existing front sight on the bow, enhances the precision of aiming of the bow and arrow over prior art bowstring sights.

These and other objects, features and advantages of the present invention together with the operation of the invention will be understood by reference to the following detailed description taken together with the accompanying drawing.

DETAILED DESCRIPTION OF THE INVENTION

Figure 1:
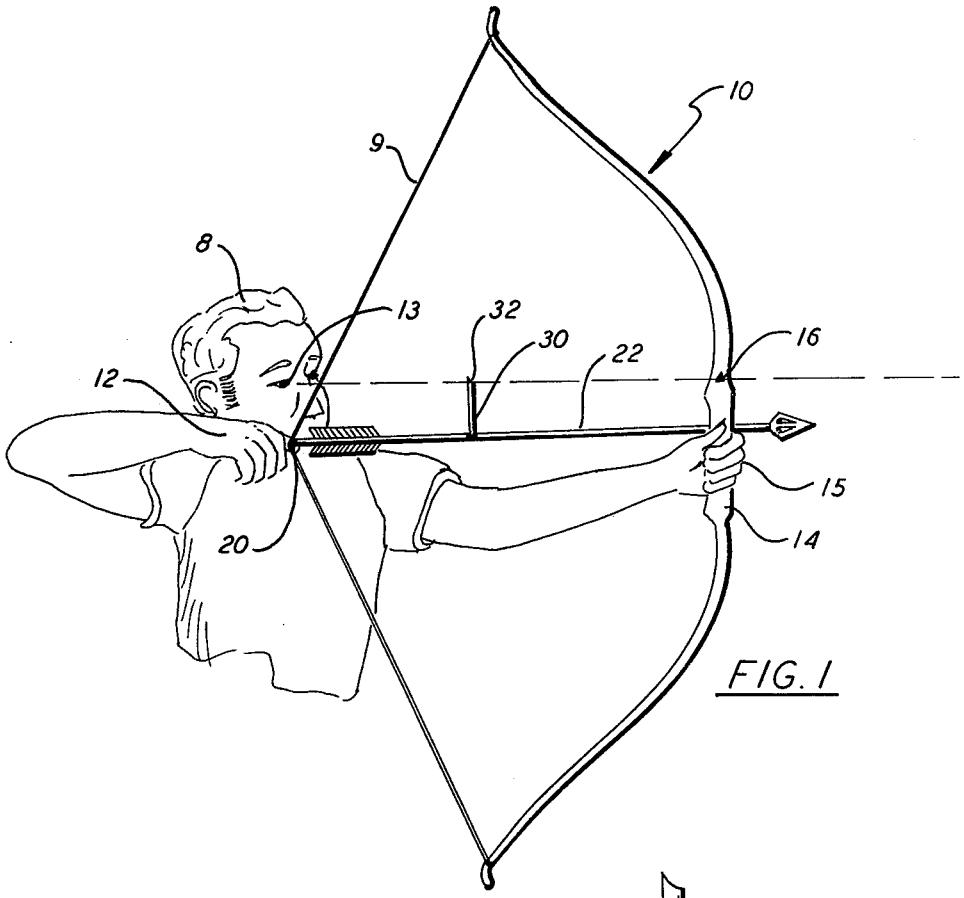
FIG. 1 is a perspective view showing the arrow mounted sight in use and showing the operation of the arrow mounted sight according to the present invention.

Referring now to FIG. 1, the arrow mounted sight according to the present invention will be described.

Archer 8 draws string 9 of bow 10 with one hand 12 while holding the frame 14 of bow 10 with the other hand 15. A front sight 16 is mounted on frame 14 of bow 10. Archer 8 sights with eye 13 using arrow mounted sight 30 and front sight 16 to aim arrow 22 at a target.

It should be pointed out that the aiming of a bow and arrow depends in large measure on the anchor point used by the archer in aiming the bow and arrow. The anchor point is the point of contact where the bowstring and drawing hand touch the face of the archer while the bow is at full draw just before the arrow is released. Generally, there are archers who use a "high anchor point" and other archers who use a "low anchor point". The high anchor point, frequently used by hunters, is where the drawing hand 12 is anchored against the side of the jaw or cheek and the bowstring 9 is drawn to the side of the face where it may or may not be in line with the eye depending upon placement of the drawing hand 12. A low anchor point on the other hand, is where the drawing hand 12 is anchored against the jaw and neck of the archer with the forefinger resting under and against the chin bringing the bowstring 9 at or near the middle of the chin and in line with the eye 13. The low anchor point is more commonly used by target archers.

Referring now to the drawing, FIG. 1 shows arrow 22 in a full draw position with arrow mounted sight 30 in the upright position to allow archer 8 to sight along the notch 32 in arrow mounted sight 30 and front sight 16 on frame 14 of bow 10.

Figure 2:
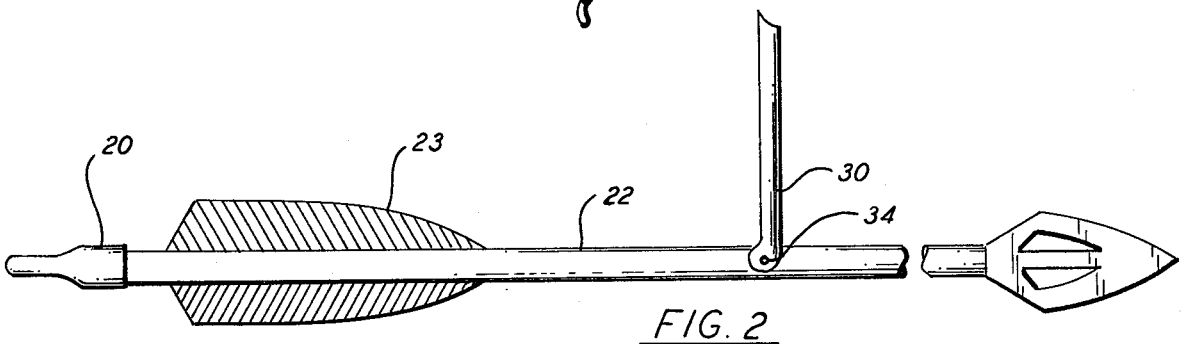
FIG. 2 is a view showing an arrow mounted sight according to the present invention in the aiming or upright position.
Figure 3:
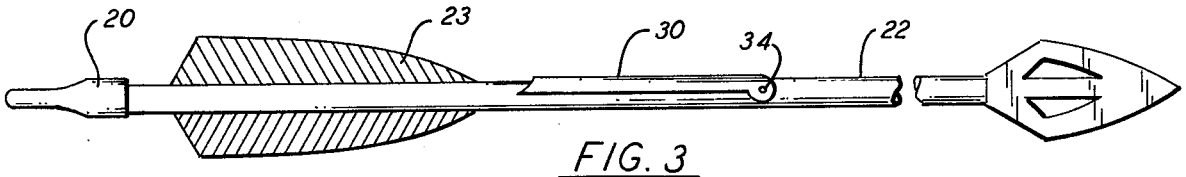
FIG. 3 is a side view showing the arrow mounted sight according to the present invention in the flight or lowered position.
Figure 4:
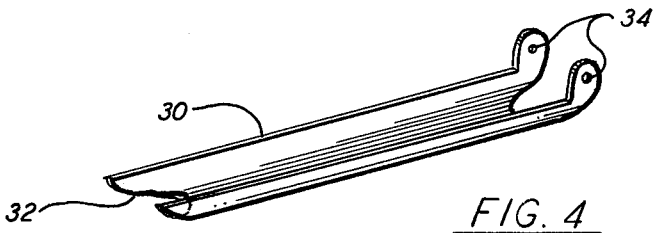
FIG. 4 is a perspective view of an arrow mounted sight according to the present invention showing in greater detail the structure of the sight.

Referring now to FIGS. 2, 3 and 4, the arrow mounted sight 30 will be described in greater detail.

Arrow mounted sight 30 has at a lower portion thereof a pair of openings 34 allowing a pin to hold the arrow mounted sight to arrow 22 such that the sight 30 may be pivoted about the pin.

FIG. 2 shows the arrow mounted sight 30 in an upright position just forward of feathers 23 on arrow 22 thus when arrow mounted sight 30 is rotated to a flight position it is laid back against the shaft of arrow 22 as shown in FIG. 3.

FIG. 4 shows the construction of the arrow mounted sight 30 in greater detail. The arrow mounted sight is generally constructed of a light material such as light plastic and it is formed with a longitudinal curvature which matches the curvature of the shaft of arrow 22 to allow the sight to lay flat and not provide any substantial change in the characteristics of flight of arrow 22. Notch 32 is cut in the upper end of sight 30 to permit a precise aiming of the arrow by the archer in conjunction with the front sight 16 on bow 10.

As archer 8 released arrow 22, the force of the moving air and the inertia of sight 30 causes sight 30 to rotate about points 34 and lay flat against the shaft of arrow 22.

An arrow mounted sight according to the present invention provides increased precision of aiming of a bow and arrow with a minimum cost without substantially changing the flight characteristics of the arrow.

While the present invention has been described with reference to a preferred embodiment thereof, it will be understood by those skilled in the art that various changes may be made in embodiments of the invention without departing from the spirit of scopt of the invention.

What is claimed is:

1. A sight for use in aiming a bow and arrow, comprising;

an arrow shaft having curvature in transverse cross section;

a curved body portion which matches the curvature of said shaft in transverse cross section means pivotally connecting said body portion to said shaft of said arrow to permit said body portion to pivot from an upright, aiming position to a folded position along said shaft when said arrow is in flight.

2. A sight according to claim 1 further comprising a notch cut into an upper end of said curved body portion for assisting an archer in aiming said bow and arrow.

3. A sight according to claim 1 further comprising a hole cut into an upper end of said curved body portion to function as a peep sight in conjunction with another sighting mechanism on a bow for assisting an archer for aiming a bow and arrow.

4. A sight according to claim 1 wherein said curved body portion is constructed of a light weight material to minimize any effect of said arrow mounted sight on arrow flight characteristics and to enhance the speed at which said sight moves from said aiming position to said folded position.

5. A sight according to claim 1 wherein said means comprises first and second pin holes in a lower portion of said body portion for attaching said sight to said shaft.

* * * * *